US005996826A

United States Patent [19]

Williams et al.

[11] Patent Number: 5,996,826

[45] Date of Patent: Dec. 7, 1999

[54] BASKET LID

[76] Inventors: Charles T. Williams, 2592 Highland Rd.; G. Thomas Williams, 2640 Highland Rd., both of Zanesville, Ohio 43701

[21] Appl. No.: 08/938,174

[22] Filed: Sep. 26, 1997

[51] Int. Cl.[6] ..... B65D 37/00

[52] U.S. Cl. ..... 217/124; 217/3 BC; 220/495.11

[58] Field of Search ..... 217/3 BC, 124; 220/495.11; 4/901, 242.1, 245.5; 150/901

[56] References Cited

U.S. PATENT DOCUMENTS 2,511,481 6/1950 Schneider ..... 220/495.11
4,949,872 8/1990 Heaps, Jr. ..... 220/495.11

*Primary Examiner*—Steven Pollard
*Attorney, Agent, or Firm*—Standley & Gilcrest LLP

[57] ABSTRACT

The present invention relates to a basket lid that is adapted to securely receive a decorative material without the use of nails, staples, screws, bolts, or adhesives. In general, the basket lid is comprised of a top side, a bottom side, a channel which separates the top side from the bottom side, and a material. The material is laid on the top side, and an adequate part of the material extends beyond the top side and into channel. The material is then secured to the basket lid simply by tucking the part of the material into the channel. The contact between the part of the material and the channel is sufficient to hold the part of the material in the channel without the use of nails, staples, screws, bolts, or adhesives.

18 Claims, 6 Drawing Sheets

BASKET LID

BACKGROUND AND SUMMARY OF THF INVENTION

The present invention relates generally to a basket lid, and more particularly to, a basket lid that is adapted to securely receive a decorative material without the use of nails, staples, screws, bolts, or adhesives. Basket lids perform a variety of purposes. For example, basket lids are utilized to prevent items from falling out of a basket, to allow easy access to items in a basket, to protect items in a basket from the elements, and to restrict the airflow to items in a basket. In addition to these functional purposes, basket lids are often decorated in order to enhance the aesthetic appeal and marketability of baskets.

A market demand currently exists for fabric-covered basket lids. To meet this demand, known art has used means such as nails, staples, screws, bolts, and adhesives to secure fabrics to basket lids. Although effective for securing fabric to a basket lid, such means typically require costs for parts, tools, and machinery. In addition, such means unnecessarily diminish the aesthetic appeal of basket lids.

In light of the deficiencies of known manufacturing processes, a need exists for a manufacturing process that does not use nails, staples, screws, bolts, or adhesives to secure fabric to a basket lid. A need also exists for a basket lid that has a decorative fabric secured to its top side in a manner that does not diminish the aesthetic appeal of the basket lid. The present invention is designed to address these needs. The present invention is also designed to reduce the cost of fabric-covered basket lids and to allow the fabric to be replaced without defacing the basket lid.

In general, the fabric-covered basket lid of the present invention is comprised of a top side, a bottom side, a channel which separates the top side from the bottom side, and a fabric. The fabric is laid on the top side, and an adequate part of the fabric extends beyond the top side and into channel. The fabric is then secured to the basket lid simply by tucking the part of the fabric into the channel. The contact between the part of the fabric and the channel is sufficient to hold the part of the fabric in the channel without the use of nails, staples, screws, bolts, or adhesives.

The present invention, however, is not limited to a basket lid that is decorated with a single layer of fabric. The material used to decorate the basket lid may be comprised of a single layer or multiple layers. Moreover, any flexible article such as cloth, foam, padding, or plastic may be substituted for the fabric. Similarly, the material may be comprised of layers of flexible articles including, but not limited to, fabrics, cloths, foams, padding, and plastic.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

The present invention is directed to a basket lid that is adapted to securely receive a decorative material without the use of nails, staples, screws, bolts, or adhesives. In performing this function, the present invention provides a simple, yet effective, process to secure decorative material to a basket lid. In addition, the decorative material can be changed an unlimited number of times without damaging or defacing the basket lid. By achieving these objectives, the present invention provides a basket lid that is labor efficient and cost efficient. Moreover, the present invention meets the market demand for a simple, charming basket lid design.

Figure 1:
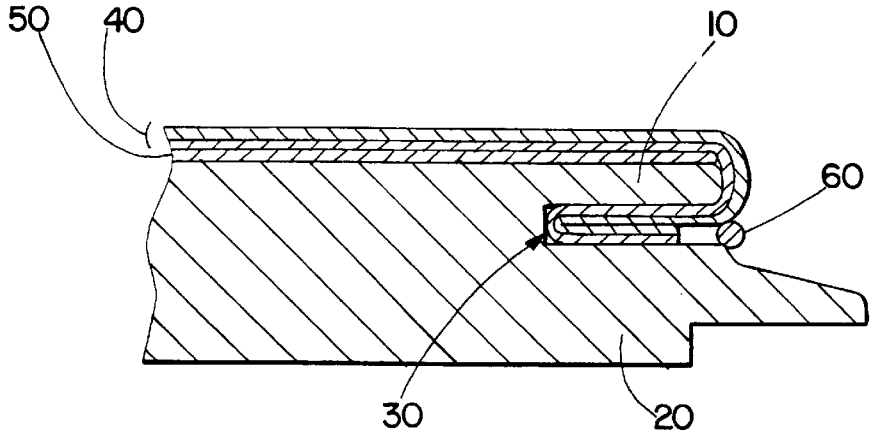
FIG. 1 is a cross-sectional view of a preferred embodiment of the present invention.

FIG. 1 illustrates a cross-sectional view of a preferred embodiment of the present invention. The basket lid has a top side 10, a bottom side 20, and a channel 30. It is well known in the art that the basket lid may have a uni-body construction. However, those skilled in the art also know that the top side 10 and the bottom side 20 may be separate units which are joined together by means such as adhesives, screws, nails, bolts, and/or staples.

The channel 30 has an interior surface which separates the top side 10 from the bottom side 20. The interior surface of the channel 30 may have a smooth finish. However, rough edges may also be created on the interior surface of the channel 30.

The channel 30 may be created by hollowing out an area between the top side 10 and the bottom side 20. The channel 30 may also be created by joining together separate units of the top side 10 and the bottom side 20. Regardless of the method used to create the channel 30, the depth and height of the channel 30 are only limited by the size of the basket lid. However, a preferred range for the depth of the channel 30 is 0.25 to 1.50 inches, and a preferred range for the height of the channel 30 is 0.01 to 0.40 inches.

A material 40 may be used to decorate the basket lid. The material 40 may be comprised of a single layer or multiple layers. In a preferred embodiment of the present invention, the material 40 is a single layer of fabric. However, the fabric may be replaced by any flexible article including, but not limited to, cloth, foam, padding, or plastic. Similarly, the material 40 may be comprised of layers of flexible articles including, but not limited to, fabrics, cloths, foams, padding, and plastics.

In order to secure the material 40 to the basket lid without the use of nails, staples, screws, bolts, or adhesives, an adequate part of the material 40 is tucked into the channel 30. In a preferred embodiment of the present invention, there is sufficient contact between the part of the material 40 and the interior surface of the channel 30. This contact holds the part of the material 40 in the channel 30.

In another preferred embodiment of the present invention, the material 40 covers the top side 10 of the basket lid. In this embodiment, the material 40 is laid on the top side 10 of the basket lid, and an adequate part of the material 40 extends beyond the top side 10 of the basket lid and into the channel 30. The part of the material 40 is tucked into the channel 30 so that there is sufficient contact between the part of the material 40 and the interior surface of the channel 30. This contact secures the material 40 to the basket lid by holding the part of the material 40 in the channel 30.

A pad 50 may be utilized to cushion the top side 10 of the basket lid. For this purpose, the pad 50 is placed on the top side 10 of the basket lid prior to laying the material 40 on the top side 10 of the basket lid. Consequently, at least a portion of the pad 50 rests between the top side 10 of the basket lid and the material 40 that covers the top side 10 of the basket lid.

Figure 2:
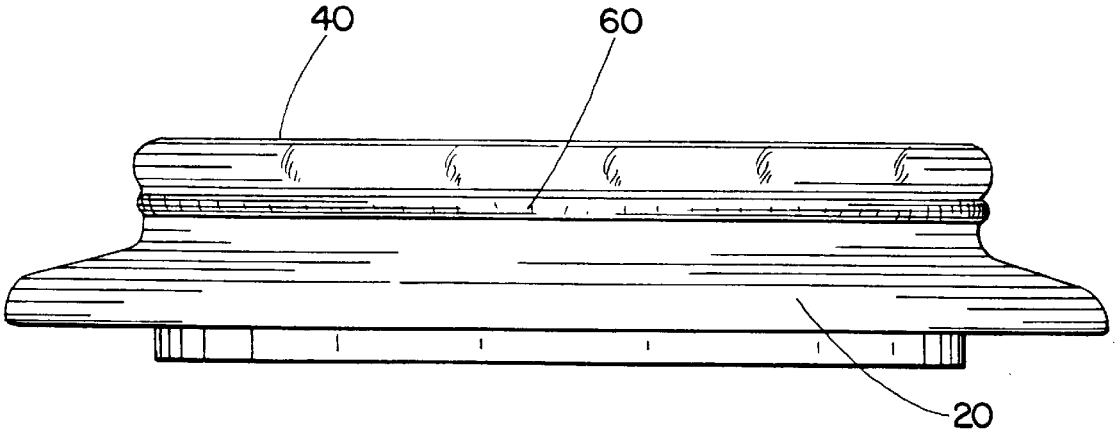
FIG. 2 is a side elevational view of a preferred embodiment of the present invention.
Figure 3:
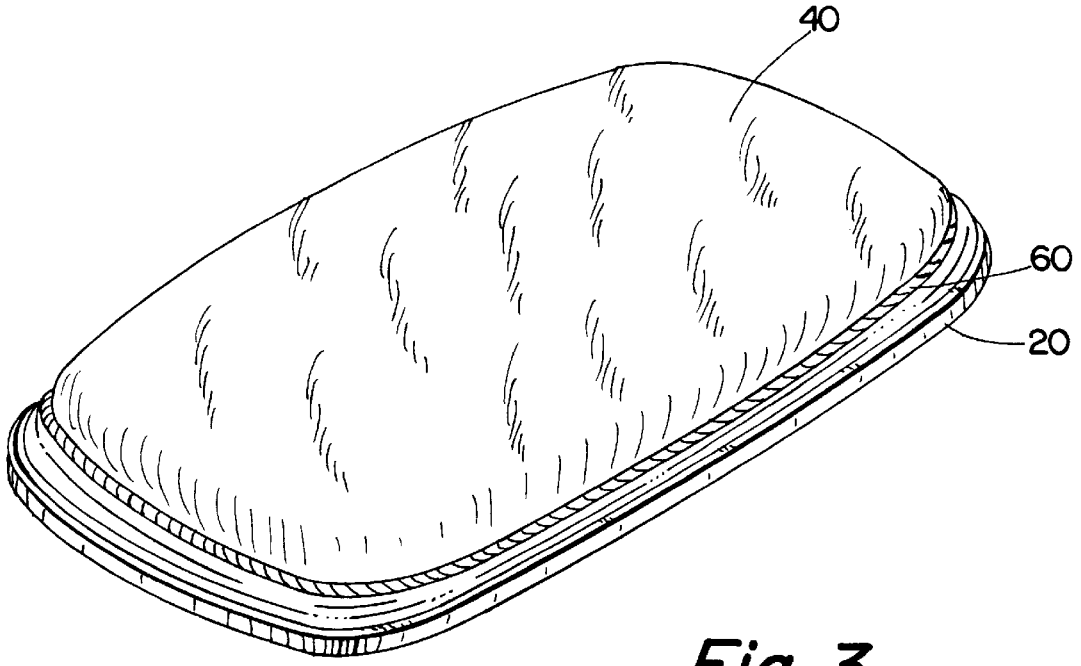
FIG. 3 is a perspective view of a preferred embodiment of the present invention.

In addition to the contact between the part of the material 40 and interior surface of the channel 30, other measures may be taken to further prevent the part of the material 40 from falling out of the channel 30. These measures may be used alone or in combination with the others. For instance, rough edges may be created on the interior surface of the channel 30 to help hold the part of the material 40 in the channel 30. Also, as shown in FIGS. 2 and 3, a b and 60 may be wrapped around the channel 30 after the part of the material 40 has been tucked into channel 30. By wrapping the band 60 sufficiently tight around the channel 30, the band 60 further prevents the part of the material 40 from falling out of the channel 30.

Figure 4:
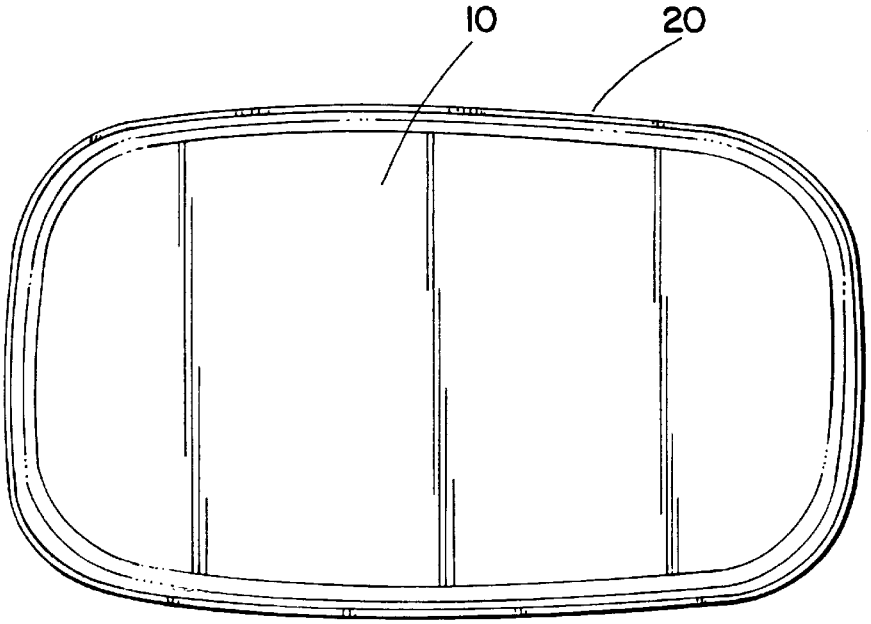
FIG. 4 is a top plan view of a preferred embodiment of a basket lid that is adapted to receive a decorative material.
Figure 5:
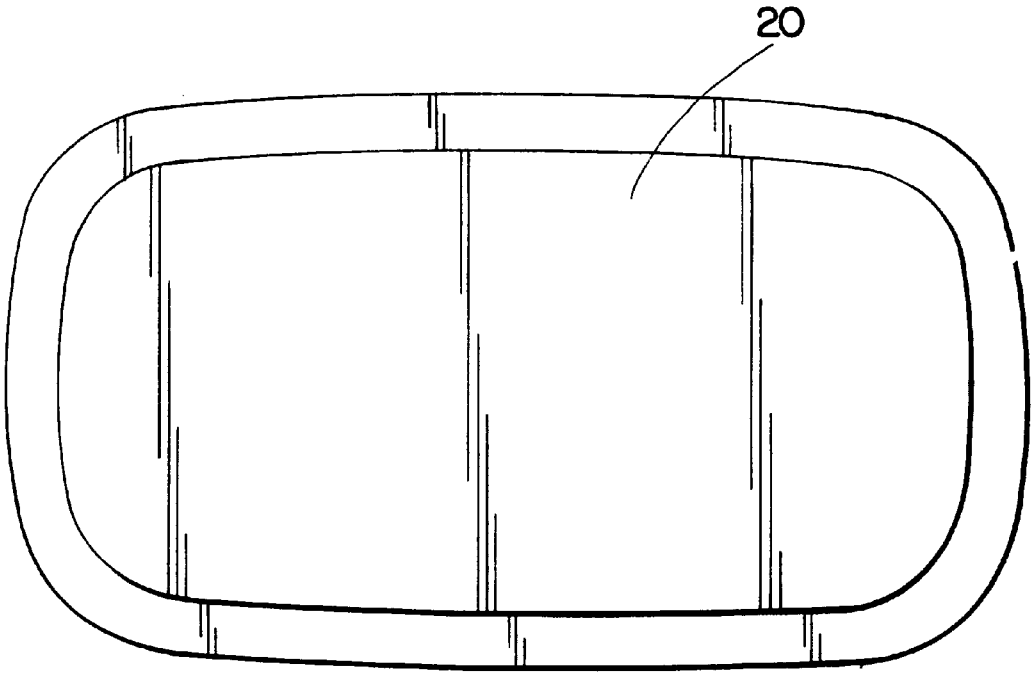
FIG. 5 is a bottom plan view of a preferred embodiment of a basket lid that is adapted to receive a decorative material.
Figure 6:
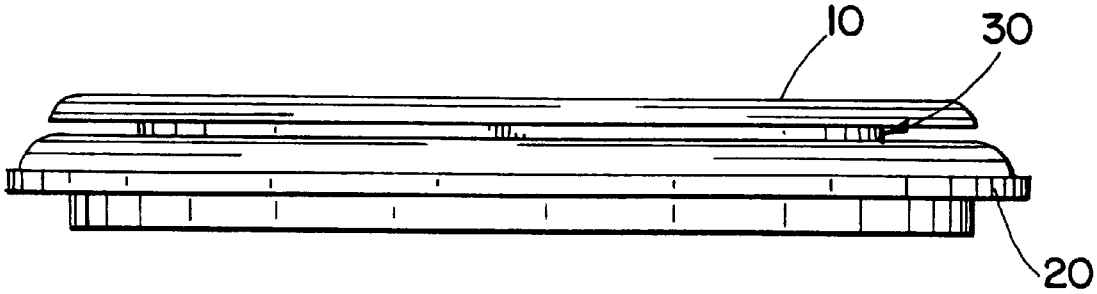
FIG. 6 is a side elevational view of a preferred embodiment of a basket lid that is adapted to receive a decorative material.
Figure 7:
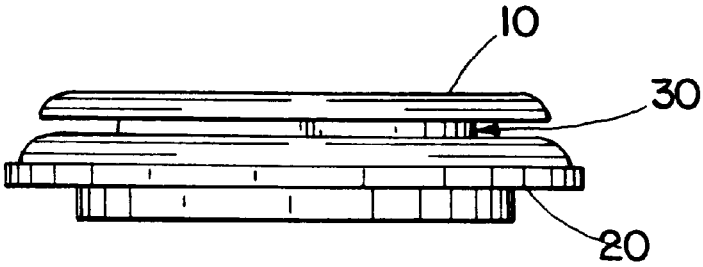
FIG. 7 is an end elevational view of a preferred embodiment of a basket lid that is adapted to receive a decorative material.

FIGS. 4 through 7 illustrate a preferred embodiment of a basket lid that is adapted to receive a decorative material. FIG. 4 is a top plan view that illustrates the top side 10 and the bottom side 20, and FIG. 5 is a bottom plan view that shows the bottom side 20. In addition, FIG. 6 is a side elevational view that shows the relationship of the channel 30 to the top side 10 and the bottom side 20, and FIG. 7 is an end elevational view that illustrates the relationship of the channel 30 to the top side 10 and the bottom side 20.

Figure 8:
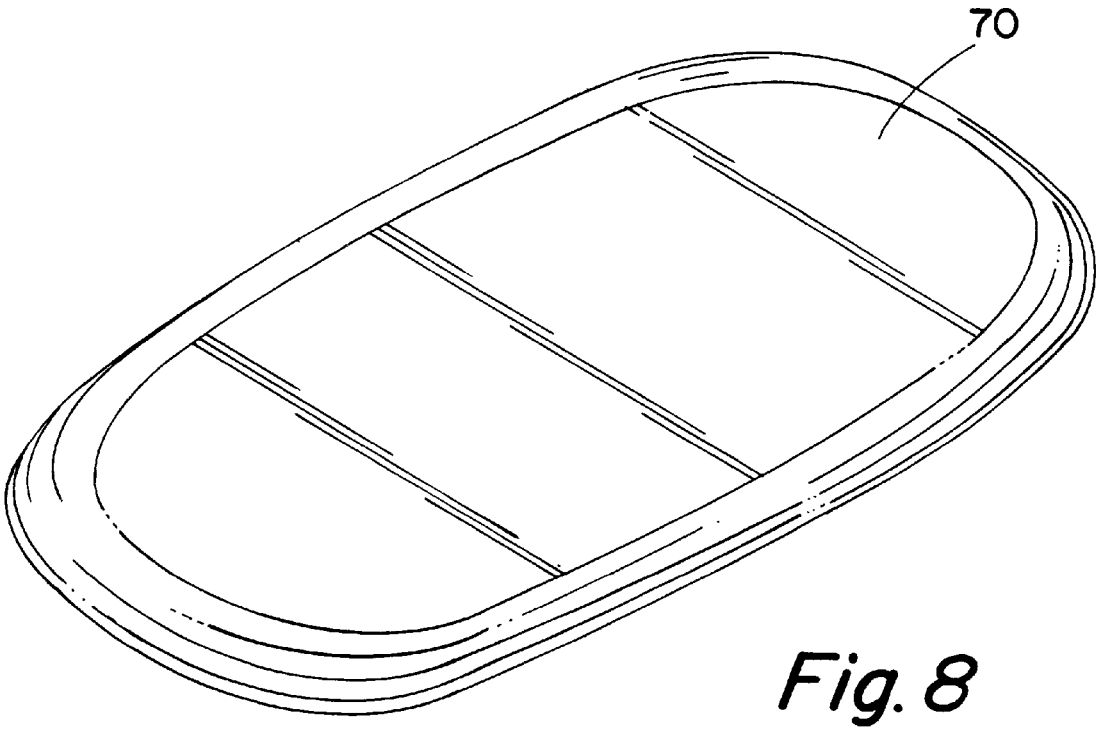
FIG. 8 is a perspective view of another preferred embodiment of a basket lid that is adapted to receive a decorative material.
Figure 9:
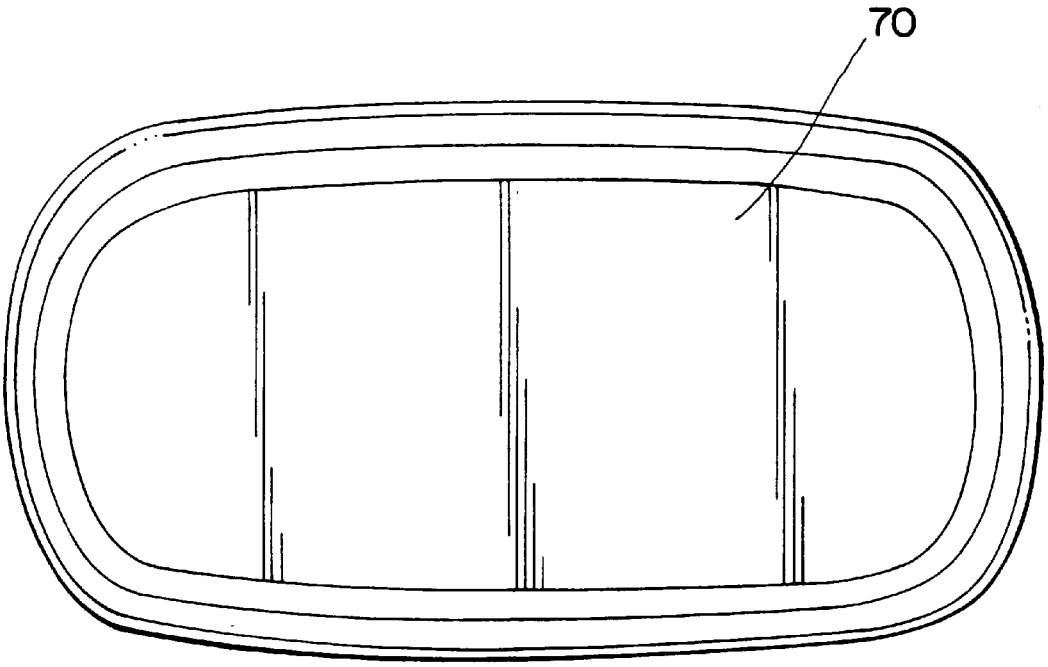
FIG. 9 is a top plan view of another preferred embodiment of a basket lid that is adapted to receive a decorative material.
Figure 10:
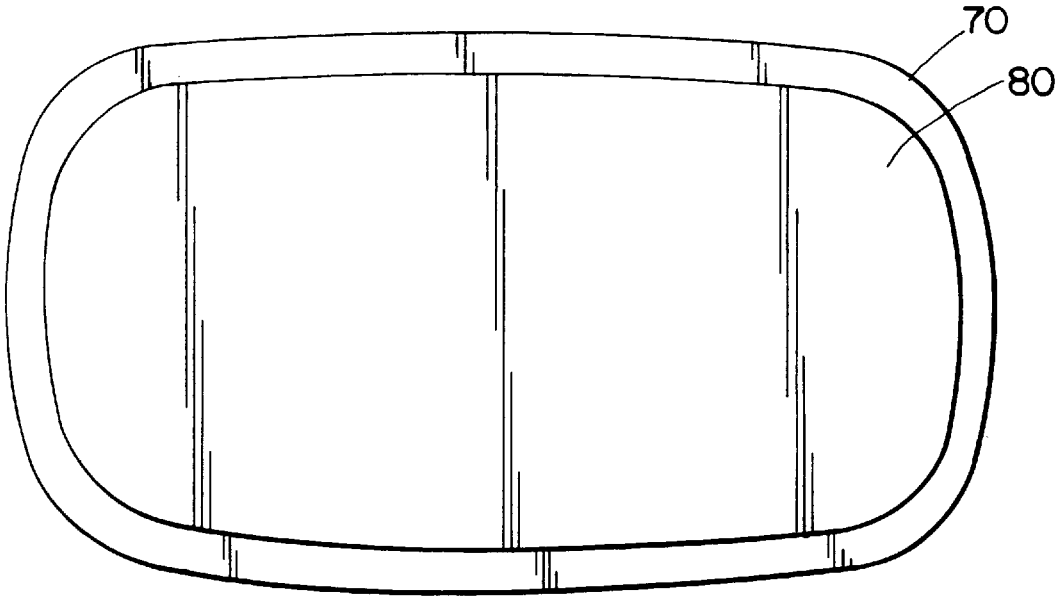
FIG. 10 is a bottom plan view of another preferred embodiment of a basket lid that is adapted to receive a decorative material.
Figure 11:
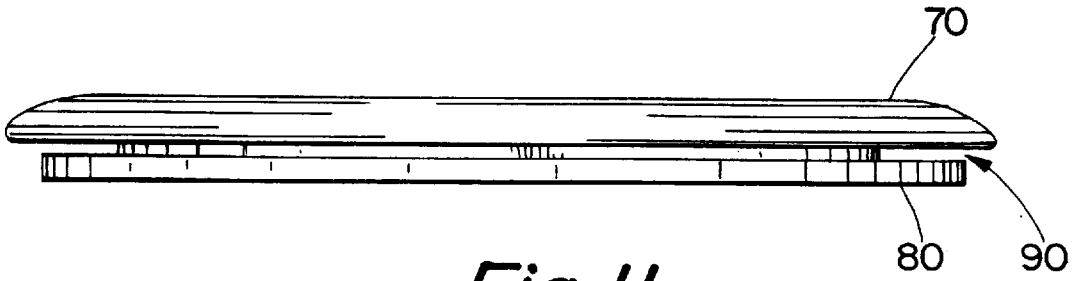
FIG. 11 is a side elevational view of another preferred embodiment of a basket lid that is adapted to receive a decorative material.
Figure 12:
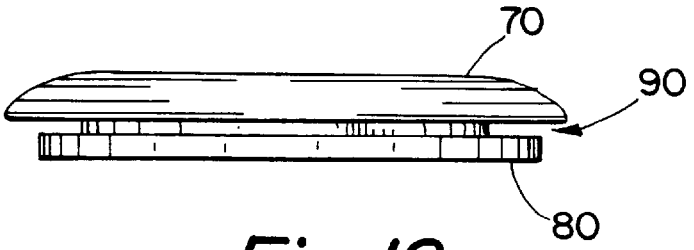
FIG. 12 is an end elevational view of another preferred embodiment of a basket lid that is adapted to receive a decorative material.

FIGS. 8 through 12 illustrate another preferred embodiment of a basket lid that is adapted to receive a decorative material. FIG. 8 is a perspective view that shows a top side 70, FIG. 9 is a top plan view that also shows the top side 70, and FIG. 10 is a bottom plan view that shows the top side 7C, and a bottom side 80. In addition, FIG. 11 is a side elevational view that illustrates the relationship of a channel 90 to the top side 70 and the bottom side 80, and FIG. 12 is an end elevational view that illustrates the relationship of the channel 90 to the top side 70 and the bottom side 80.

Figure 13:
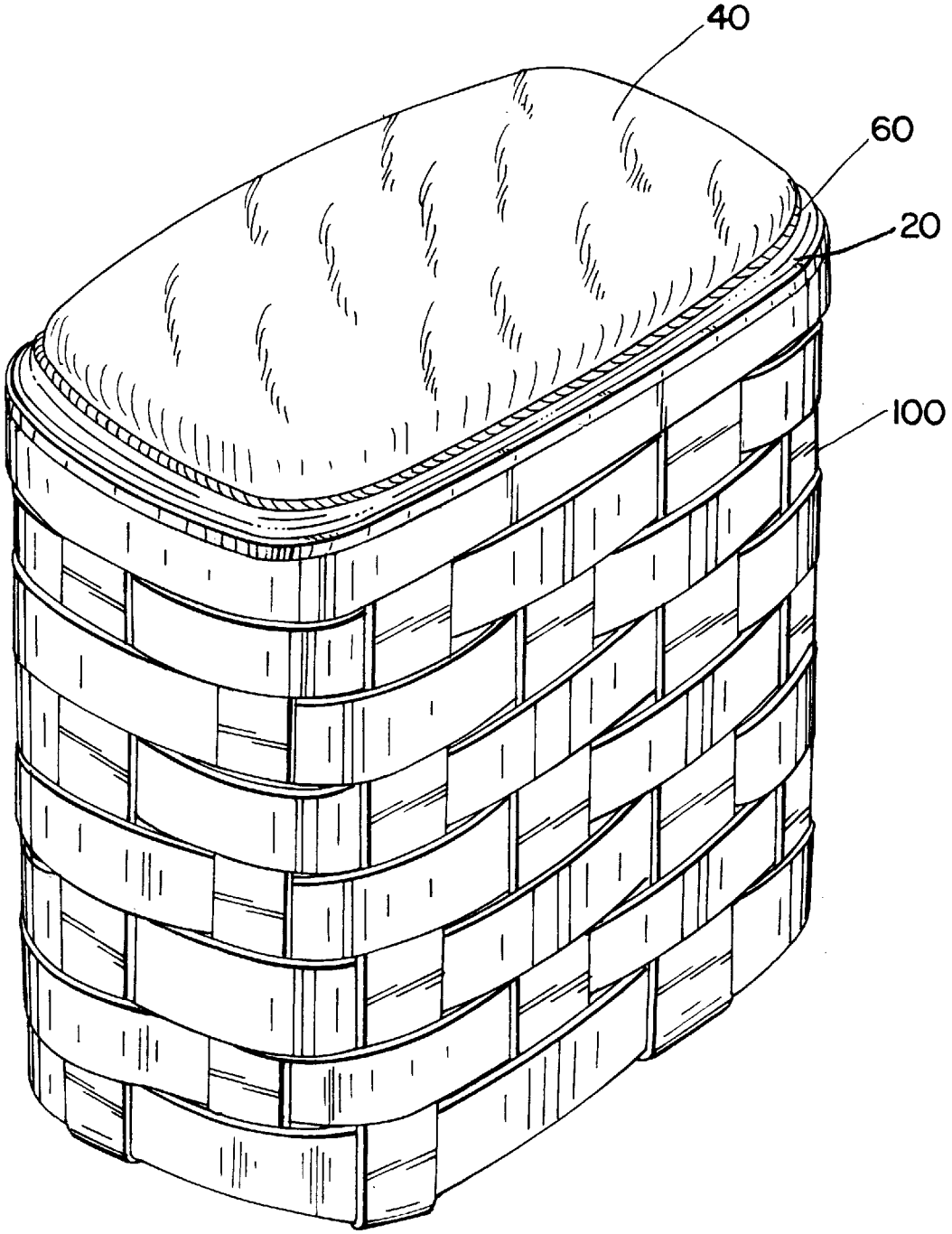
FIG. 13 is a perspective view of a basket that is covered by a preferred embodiment of the present invention.

Finally, FIG. 13 a perspective view of a basket 100 that is covered by a preferred embodiment of the present invention. The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A process for securing a material to a basket lid without the use of nails, staples, screws, bolts, or adhesives, said process comprising:

creating a channel in the basket lid, said channel having a width based on the thickness of the material;

tucking a portion of the material into the channel, whereby the friction between the material and the interior surface of the channel is sufficient to retain the material in the channel independent of any secondary fastening means.

2. The process of claim 1 wherein the material has multiple layers.

3. The process of claim 2 further comprising the step of creating rough edges on the interior surface of the channel;

whereby the rough edges further prevent the part of the material from falling out of the channel.

4. The process of claim 2 further comprising the step of:

wrapping a band sufficiently tight around the channel after the part of the material has been tucked into the channel;

whereby the band further prevents the part of the material from falling out of the channel.

5. The process of claim 2 further comprising the steps of:

creating rough edges on the interior surface of the channel; and wrapping a band sufficiently tight around the channel after the part of the material has been tucked into the channel;

whereby the rough edges and the band further prevent the part of the material from falling out of the channel.

6. The process of claim 1 further comprising the step of creating rough edges on the interior surface of the channel;

whereby the rough edges further prevent the part of the material from falling out of the channel.

7. The process of claim 6 further comprising the step of:

wrapping a band sufficiently tight around the channel after the part of the material has been tucked into the channel;

whereby the band further prevents the part of the material from falling out of the channel.

8. The process of claim 1 further comprising the step of:

wrapping a band sufficiently tight around the channel after the part of the material has been tucked into the channel;

whereby the band further prevents the part of the material from falling out of the channel.

9. A process for securing a material to a basket lid without the use of nails, staples, screws, bolts, or adhesives, said basket lid having a top side and a bottom side, said process comprising:

creating a channel in the basket lid, said channel having a width based on the thickness of the material and having an interior surface that separates the top side of the basket lid from the bottom side of the basket lid;

laying the material on the top side of the basket lid such that an adequate part of the material extends beyond the top side of the basket lid;

tucking a portion of the material into the channel, whereby the friction between the material and the interior surface of the channel is sufficient to retain the material in the channel independent of any secondary fastening means.

10. The process of claim 9 wherein the material has multiple layers.

11. The process of claim 9 further comprising the step of creating rough edges on the interior surface of the channel;

whereby the rough edges further prevent the part of the material from falling out of the channel.

12. The process of claim 9 further comprising the step of:

wrapping a band sufficiently tight around the channel after the part of the material has been tucked into the channel;

whereby the band further prevents the part of the material from falling out of the channel.

13. The process of claim 9 further comprising the step of:

placing a pad on the top side of the basket lid prior to laying the material on the top side of the basket lid;

whereby the pad cushions the top side of the basket lid.

14. A basket lid comprising:

a top side;

a bottom side;

a channel having a width based on the thickness of a covering material and having an interior surface which separates the top side from the bottom side;

a material for covering the top side, said material of sufficient size such that a portion thereof extends beyond the top side and into the channel; and whereby the friction between the material and the interior surface of the channel is sufficient to hold the material in the channel independent of any secondary fastening means.

15. The basket lid of claim 14 wherein the material has multiple layers.

16. The basket lid of claim 14 wherein the interior surface of the channel has rough edges, said rough edges further preventing the part of the material from falling out of the channel.

17. The basket lid of claim 14 further comprising a band wrapped around the channel, said band further preventing the part of the material from falling out of the channel.

18. The basket lid of claim 14 further comprising a pad for cushioning the top side, at least a portion of said pad resting between the top side and the material that covers the top side.

* * * * *